US006116247A

United States Patent [19]

Banyasz et al.

[11] Patent Number: 6,116,247

[45] Date of Patent: Sep. 12, 2000

[54] CLEANING UNIT FOR THE HEATER FIXTURE OF A SMOKING DEVICE

[75] Inventors: Joseph Leslie Banyasz; Aubry T. Burton, both of Richmond; John M. Campbell; Woontung Geoffrey Chan, both of Chesterfield; Mary Ellen Counts, Richmond; William James Crowe, Chester; Jay A Fournier, Richmond; Patrick H. Hayes, Chester; Willie Gray Houck, Jr., Richmond; Robert E. Lee, III, Richmond; Donald Bruce Losee, Richmond; John B. Paine, III; Robert L. Ripley, both of Midlothian; Charles Edwin Thomas, Jr., Richmond, all of Va.

[73] Assignee: Philip Morris Incorporated, New York, N.Y.

[21] Appl. No.: 09/176,028

[22] Filed: Oct. 21, 1998

[51] Int. Cl.[7] ..... A24F 3/02; A24F 9/04; A24F 9/12

[52] U.S. Cl. ..... 131/244; 131/243; 131/329

[58] Field of Search ..... 131/329, 194, 131/173, 270, 271, 273, 330, 243, 244, 184.1; 128/202.21, 203.27 A

[56] References Cited

U.S. PATENT DOCUMENTS

| | | | |
|---|---|---|---|
| 1,730,022 | 10/1929 | Von Arx | 285/8 |
| 2,412,531 | 12/1946 | Pape | 285/8 |
| 5,388,594 | 2/1995 | Counts et al. | 131/329 |
| 5,505,214 | 4/1996 | Collins et al. | 131/194 |
| 5,591,368 | 1/1997 | Fleischauer et al. | 219/535 |
| 5,692,525 | 12/1997 | Counts et al. | 131/194 |
| 5,878,752 | 3/1999 | Adams et al. | 131/329 |

*Primary Examiner*—Stanley S. Silverman
*Assistant Examiner*—Dionne A. Walls
*Attorney, Agent, or Firm*—Burns, Doane, Swecker & Mathis, LLP

[57] ABSTRACT

A cleaning unit used to clean condensates formed during use of a component of a smoking system. The component can be a heating fixture having a cigarette receiving section and a plurality of longitudinally extending circumferentially spaced apart heating elements located within a can which accumulates the condensates. During a cleaning operation, the heating fixture is fitted within a cavity in the cleaning unit such that the cigarette receiving end of the heating fixture engages an O-ring and the terminal base portion abuts against an indented stop in an interior sidewall of a removable portion of the housing. The cleaning unit includes a water inlet connected to a source of pressurized water such as a faucet and a spray member extends into the cigarette receiving section to spray jets of water against the interior of the can. The housing can include a main flow passage which supplies pressurized water to the spray member and one or more bypass passages whereby water used to clean the heating fixture can exit the housing through one outlet and water which bypasses the heating fixture can exit the housing through other outlets. The housing can include a pulsating mechanism to pulsate jets of pressurized water against the interior of the heating fixture.

42 Claims, 11 Drawing Sheets

CLEANING UNIT FOR THE HEATER FIXTURE OF A SMOKING DEVICE

FIELD OF THE INVENTION

The invention relates to a cleaning unit for use with a component of a cigarette smoking system. More particularly, the invention relates to a cleaning unit which cleans the component via a source of pressurized water.

BACKGROUND OF THE INVENTION

Commonly assigned U.S. Pat. Nos. 5,388,594; 5,505,214; and 5,591,368 disclose various electrically powered smoking systems comprising electric lighters and cigarettes. The systems provide smoking pleasure while significantly reducing side stream smoke and permitting the smoker to selectively suspend and reinitiate smoking. During operation of such smoking systems, condensate can collect on various parts of the heating fixture. In order to remove such condensates, the smoking device may include a heating component which is used to drive off such condensates. Even with such a heating component, it may not be possible to remove as much of the condensates as desired. Further, the smoking pleasure derived from the smoking system may be adversely affected by condensate build-up in areas which cannot be sufficiently heated to drive off the condensates.

SUMMARY OF THE INVENTION

The invention provides a cleaning unit for removing condensates from a component of a smoking device. The unit includes a housing having a cavity therein adapted to receive a component of a smoking device, an inlet adapted for connection to a source of pressurized water and a flow passage adapted to direct pressurized water to a portion of the component to be cleaned. During cleaning, the flow passage directs the pressurized water into contact with the component to remove the condensates.

If an interior of the component is to be cleaned, the housing can include a tubular member which directs jets of pressurized water radially outward against an inner surface of the component. Regardless of the shape of the component, the housing can include bypass passages which allow some of the water to bypass the component. If desired, a pulsation member can be provided in the housing which causes changes in pressure of the pressurized water passing through a spray member. The pulsation member can comprise a rotatable element having one or more holes adapted to intermittently block supply of at least some of the pressurized water to bypass passages or the spray member during rotation of the pulsation member In a preferred embodiment, the component comprises a heating fixture of a smoking device wherein a cigarette is heated by one or more heating elements and smoke condensate builds up in an interior of the heating fixture. The housing can include a main body and a removable section, the removable section including a surface which engages the heating fixture when the heating fixture is in the cavity and the removable section is attached to the main body. A spray member can be provided in the housing to direct one or more jets of pressurized water against the interior of the heating fixture when pressurized water is supplied to the inlet. The housing can include a bypass flow passage which allows some of the pressurized water supplied to the inlet to pass through the housing without contacting the component. The housing can also include a pulsation member which causes changes in pressure of the pressurized water passing through the flow passage. One or more sealing members can be provided in the cavity for engaging an exterior of the component and sealing off a portion of the cavity from the pressurized water.

In the case where the heating fixture includes at least one port providing a fluid passage for controlled flow of air from the exterior to the interior of the heating fixture, the housing can include a first sealing member in the cavity engaging a first portion of the heating fixture and a second sealing member engaging a second portion of the heating fixture, the first and second sealing members forming a pressurized space in fluid communication with the port. In the case where the heating fixture includes longitudinally extending and circumferentially spaced apart heating elements, the spray member can include outlets oriented with respect to the heating fixture so as to direct jets of pressurized water between the heating elements. In the case where the heating fixture includes a cylindrical can enclosing the heating elements and the can has an inner surface on which the condensates accumulate during use of the heating fixture in the smoking device, the spray member can be oriented such that the jets of pressurized water impinge against the inner surface of the can.

In order to facilitate cleaning of the heating fixture, the heating fixture can be specially designed to aid removal of water and condensate. For instance, the heating fixture can include one or more drainage holes. In the case where the heating fixture includes a base at one end thereof, a tubular housing extending from the base and a cylindrical can spaced inwardly of the tubular housing, the base can be modified to include at least one drainage hole extending from a space between the tubular housing and the can. In the case where the base includes an inner surface which defines an opening having a central axis which passes through an end wall of the base, the one or more drainage holes can be oriented so as to extend through the inner surface at an acute angle to the central axis.

DETAILED DESCRIPTION OF THE PREFERRED EMBODIMENTS

The present invention provides a washing unit which is effective in removing built up condensates on an electrical component such as a heating fixture of a smoking system. A heating fixture which can be cleaned with the cleaning unit can be of the type used in an electrical cigarette smoking system. An example of such a smoking system is described in U.S. Pat. No. 5,692,525, the entire content of which is hereby incorporated by reference. In such a smoking system, a logic circuit can monitor a change in pressure when a smoker draws on a cigarette loaded in the smoking device and sequentially activate one of a plurality of heater elements located circumferentially around the cigarette. During smoking, the heating fixture accumulates particles of condensate within its structure, resulting in clogged air pathways and/or undesirable taste during subsequent operation of the smoking system. In accordance with the present invention, it has been found desirable to periodically wash out the interior of the heating fixture with an aqueous fluid such as heated water to dissolve and remove these particles. The present invention provides a cleaning unit which can be used for this purpose. However, the cleaning unit of the invention can be designed to clean deposits from other types of electrical components which accumulate undesirable deposits whether or not such components form part of a smoking device.

Figure 1:
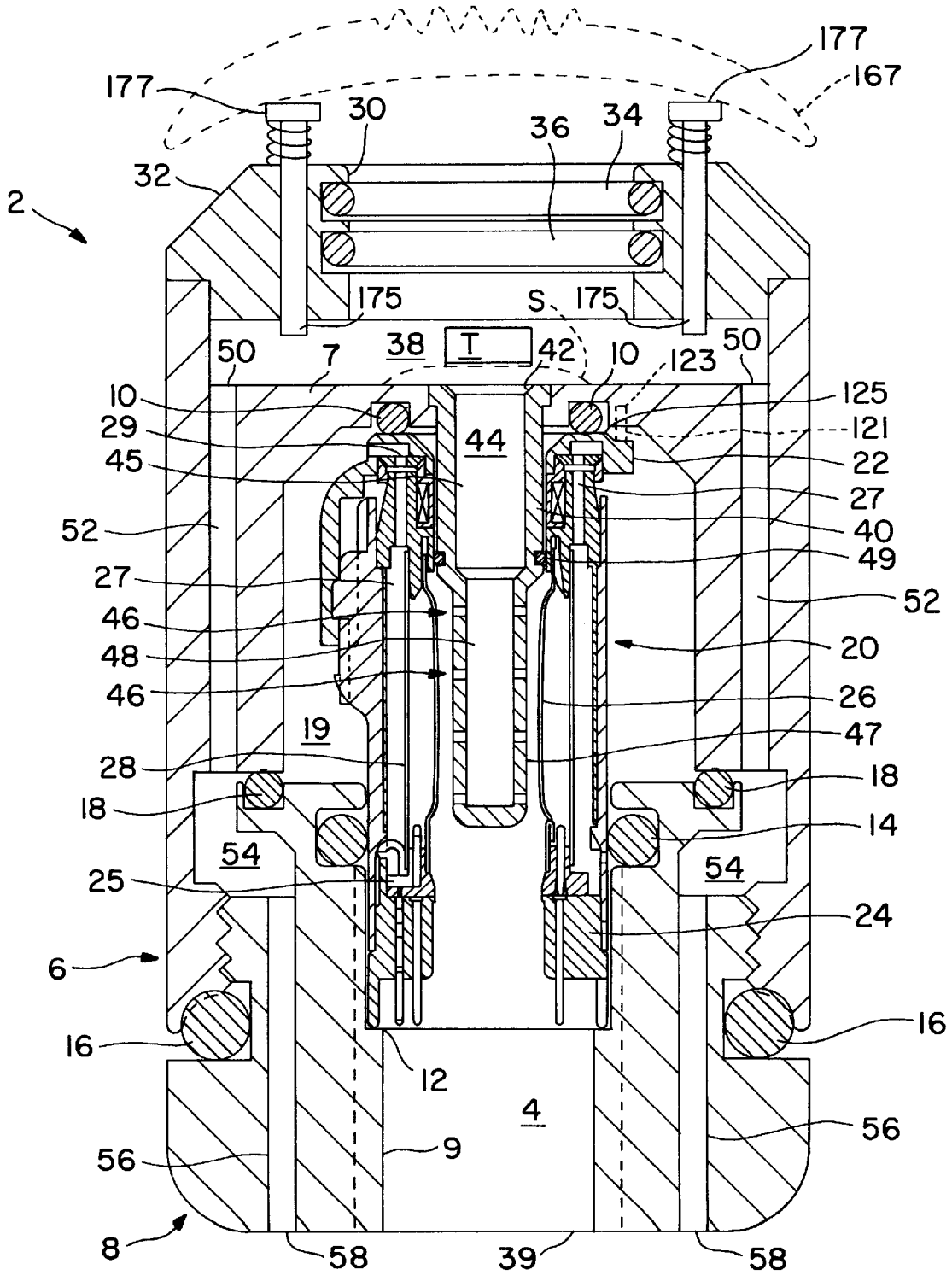
FIG. 1 shows a preferred embodiment of a cleaning unit in accordance with the invention.

FIG. 1 illustrates an embodiment of a cleaning unit 2 in accordance with the present invention. As shown, the cleaning unit can be used to clean a component of a smoking system such as a heating fixture 20 which can be removed from the smoking system, as explained below.

Figure 2:
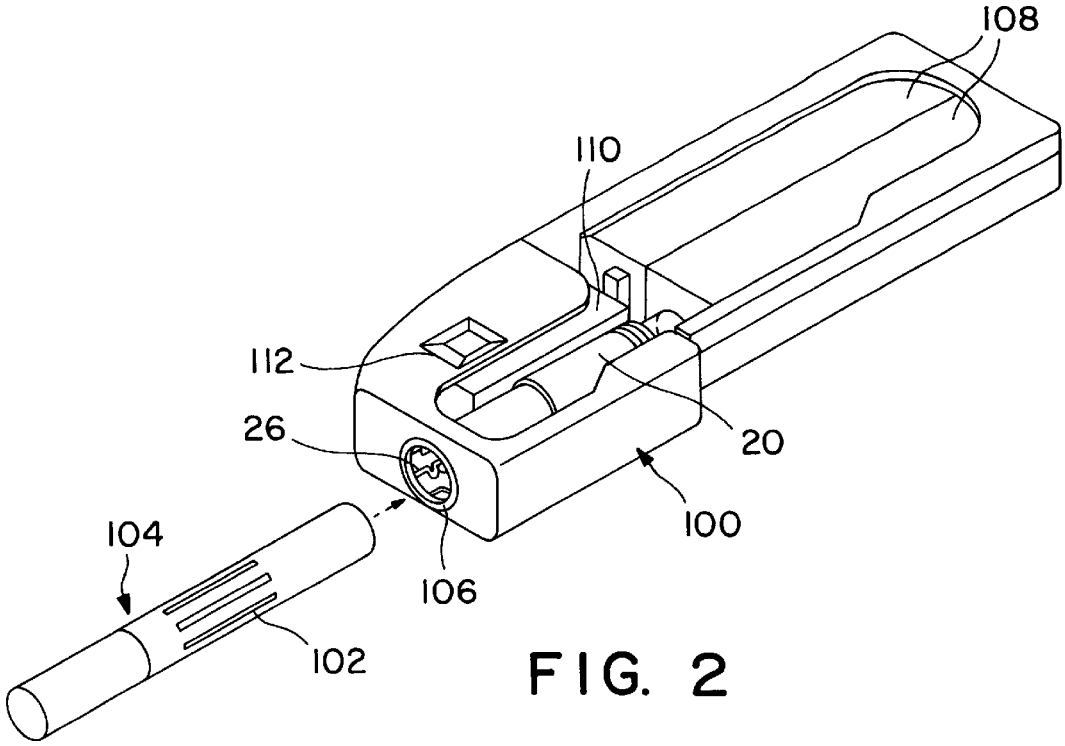
FIG. 2 shows a perspective view of a cigarette smoking system which includes a removable heating fixture which can be cleaned in the cleaning unit shown in FIG. 1.

FIG. 2 shows a cigarette smoking system 100 which includes a removable heating fixture 20. The heating fixture 20 includes heating elements which are electrically powered to heat a strip 102 along a cigarette 104. As shown in FIG. 1, the heating fixture 20 includes a cigarette receiving section 22, a terminal base 24, a plurality of longitudinally extending heating elements 26 and a can 28. The cigarette 104 is smoked by inserting the cigarette 104 in an opening 106 of the smoking device 100. The smoking device 100 includes batteries 108, a logic circuit 110 and a display 112 for indicating the number of puffs remaining to be smoked. During use of the smoking device 100, condensates from the cigarette smoke accumulate in the heating fixture. In order to clean the heating fixture, the heating fixture is removed from the smoking system 100 and placed in the cleaning unit 2. During a cleaning operation, the heater fixture 20 is fitted within a cavity 4 in the cleaning unit 2.

The cleaning unit 2 can include an upper section 6 and a lower section 8 removably attached to the upper section 6. The heating fixture 20 can be inserted into the cavity 4 such that the cigarette receiving end 22 of the heating fixture 20 engages an O-ring 10 located in a groove of an interior end wall 7 of the upper section 6 and the terminal base portion 24 of the heating fixture 20 abuts against an indented stop 12 in an interior sidewall 9 of the lower section 8. An O-ring 14 provides a water-tight seal between an outer surface of the heater fixture 20 and the interior of the lower section 8. Additional O-rings 16, 18 between the upper and lower sections provide a water-tight connection between the housing sections when the lower section 6 is threaded into the upper section 8.

The cleaning unit includes a water inlet 30 in the end 32 of the upper section 6. The inlet 30 can receive a source of pressurized water such as a faucet. In order to provide a good connection with the pressurized source of water, the inlet can include O-rings 34, 36 or other sealing arrangement such as screw threads to engage a faucet or other source of pressurized water such as a hose. The inlet 32 allows pressurized water to enter a cavity 38 for distribution through one or more flow passages. According to an embodiment of the invention, the cavity 38 is of sufficient size to receive a cleaning tablet T (shown in phantom in FIG. 1) that is gradually dissolvable in water to facilitate the cleaning process. The tablet T may be supported away from the inlet 42 of the manifold 40 by, for example, a curved screen S. Water used to clean the heating fixture exits the housing 2 through outlet 39 in the lower section 8.

In order to enhance cleaning of the interior of the heating fixture, a distribution manifold 40 is supported in the cavity 4 such that it fits within the interior of the heating fixture 20 when the heating fixture is clamped between the upper and lower sections 6, 8 of the housing 2. The distribution manifold 40 includes an inlet 42, a flow passage 44 and outlets 46 which direct water jets radially outward towards the interior of the heating fixture. In order to increase the force of blast provided by the outlets 46, the outlets 46 can be located in a reduced diameter flow passage 48. In order to prevent water from leaking between the distribution manifold 40 and the heating fixture 20, the manifold can include an O-ring 49 located in a groove in the outer surface of the manifold. The O-ring 49 engages the interior of the cigarette receiving section 22 of the heating fixture 20. In the embodiment shown in FIG. 1, the manifold has an upper larger diameter portion 45 sized to fill the cigarette receiving section 22, a lower smaller diameter portion 47 sized to fit inside the heating elements 26 and the O-ring 49 is at a lower end of the upper portion.

The housing 2 can include a water bypass arrangement which allows some of the water entering the cavity 38 to flow out of the housing without performing a cleaning function. For instance, one or more inlets 50 can be provided in the upper section 6 can be used to direct water through flow passages 52 in the upper section 6 to a reservoir 54 between the upper and lower sections and then through passages 56 in the lower section 8 and out of outlets 58 in the lower section. In this way, the contaminated water exiting outlet 39 can be diluted with the water exiting the outlets 58.

The cleaning unit 2 can be operated in the following manner. After placing the heating fixture in the cavity 4 and attaching the upper and lower sections together, the inlet 30 is attached to a pressurized source of water such as a sink water faucet by pressing the faucet through the O-rings 34, 36 shown in FIG. 1. Water, preferably hot water at a temperature of 90° F. or higher, enters the cleaning unit and flows through the distribution manifold 40 or through the bypass passages 52 which can allow a large percentage of the cleaning water, e.g., up to 80%, to bypass the heater fixture 20 and exit through outlets 58. The bypass passage arrangement can prevent excessive pressure build up within the cleaning unit and/or dilute the water exiting the outlet 39. The remainder of the water can be directed into the interior of the heating fixture 20 by the distribution manifold 40. The outlets 46 of the distribution manifold 40 can be arranged in a pattern which develops a high pressure, turbulent spray within the heating fixture. In a preferred embodiment, the outlets 46 are arranged such the water sprays pass between individual heating elements 26 of the heating fixture. In this way, the distribution manifold can distribute the cleansing water against the inner can 28 of the heater fixture 20 where most of the condensate is built up during use of the smoking system. During cleaning, the condensates can be dissolved and washed from the heater fixture 20 through outlet 39.

During use of the smoking system, the heating elements are heated to a high enough temperature to avoid significant build up of condensate on the heating elements. Instead, the condensate tends to accumulate mostly on the inner can 28. As the heating elements are spaced apart in a circumferential direction, the cleansing water is preferably sprayed through the gaps between the heating elements 26. In the embodiment shown, the heating fixture includes eight heating elements 26, each of which comprises a thin metallic strip. In order to orient the outlets of the distribution manifold such that the jets of water pass between the heating elements, the heating fixture can be designed to fit in the cavity 4 in a manner which provides the desired orientation. For instance, the heating fixture and distribution manifold can be keyed to one another such that the outlets 46 are located between the heating blades 26.

Although the embodiment of the cleaning unit described above includes a distribution manifold, other arrangements for directing water inside the heating fixture can be used. For instance, the housing 2 can be designed such that the heating fixture is held in the cavity 4 without a specific orientation between the heating fixture and the distribution manifold, in which case the outlets 46 will direct water sprays in random directions with respect to the locations of the heating blades. Another possibility is to allow the heating fixture and distribution manifold to rotate relative to each other. Still yet, the distribution manifold could be replaced with another spray member which causes pressurized water to strike the interior of the can 28. Such a spray member could be in the form of a deflector mounted in the upper section and/or lower section of the housing 2.

The cleaning unit is preferably designed to avoid damage to sensitive electrical and/or airflow components of the heating fixture. For example, the heating fixture may include circuitry which should be kept dry and/or there may be flow passages which should not become clogged or otherwise restricted with respect to flow of air or cigarette smoke therethrough. In the embodiment of the heating fixture 20 shown in FIG. 1, one or more air flow ports 27 may be provided for control resistance-to-draw and/ total airflow into the smoking system. In addition, the heating fixture may include a screen 29 of suitable material such as paper or wire cloth at the entrance of the ports 27. According to a preferred embodiment of the invention, the cleaning unit includes a pressurized sealing arrangement which protects the screen 29 and ports 27 from coming into contact with the water passing through the cleaning unit. One arrangement for achieving this result is the arrangement of the O-rings 10, 14 an 18 which allow the formation of an air-tight pressurized space 19 around the exterior of the heating fixture 20. Because air in the space 19 is pressurized by water entering the ports 27, if water passing into the interior of the heating fixture backs up and begins to fill the ports 27, the air-tight space 19 will become pressurized and limit the progression of the water build up in the ports 27. The pressure space 19 thus functions to form a pressure barrier for preventing unwanted cleansing water from flowing through the ports 27 and maintains screen 29 condensate free.

Figure 3C:
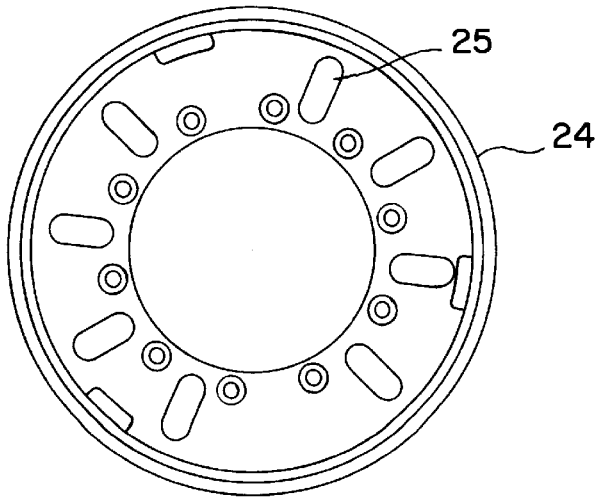
FIGS. 3 A–C show modifications to a portion of the heating fixture shown in FIG. 2.
Figure 3A:
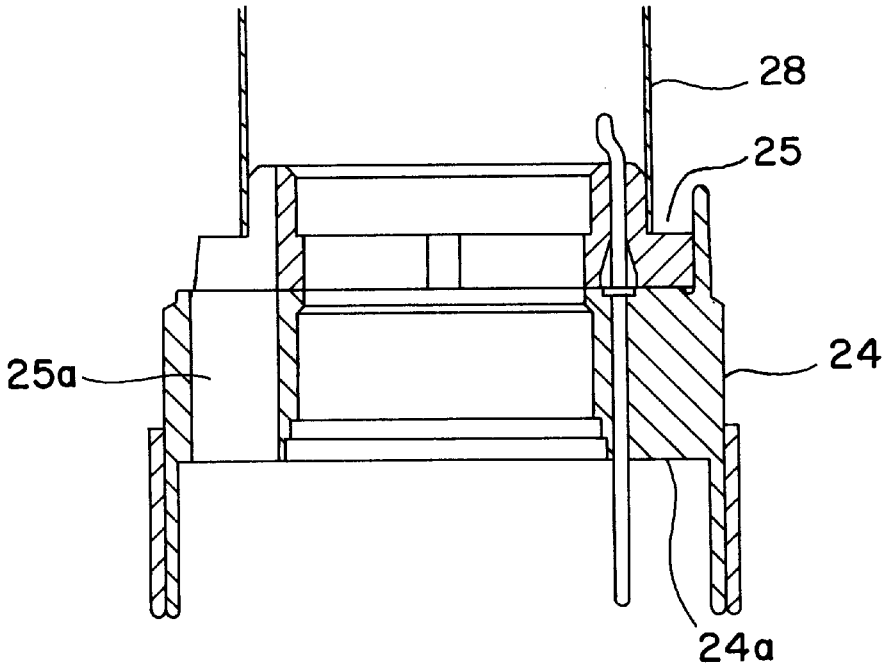
Figure 3B:
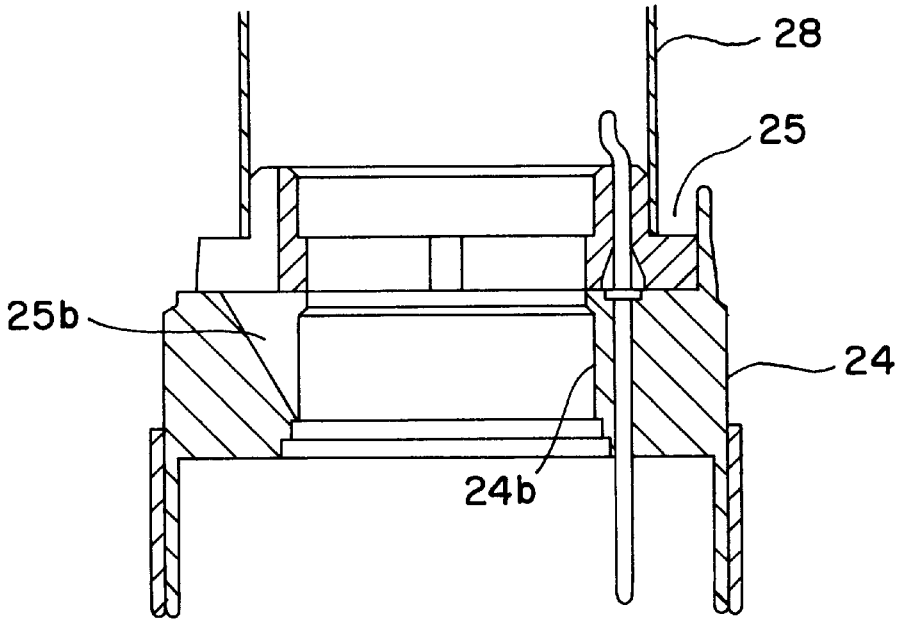

During cleaning of the heating fixture, cleansing water and solubles can accumulate in well area 25 at the lower end of the can 28 just above terminal base 24. According to the invention, the heating fixture can be modified to allow draining of the well area. FIGS. 3A and 3B show modifications of the heating fixture 20 wherein the well area 25 is modified to include one or more drainage holes and FIG. 3C shows a cross section of the base 24. For instance, one or more drainage holes 25*a* can extend through an end wall 24*a* of the base 24, as shown in FIG. 3A. Alternatively, drainage holes 25*b* can extend through inner wall 24*b* of the base 24, as shown in FIG. 3B. The drainage holes 25*b* can be at an acute angle to the central axis A of the heating fixture. For example, the bottom of the drainage holes can be at an angle of 15 to 60 degrees, e.g., 31 degrees as shown. The drainage arrangement in FIG. 3B is advantageous in that it does not change the existing air flow characteristics of the heating fixture when it is used in the smoking system. The FIG. 3A arrangement may or may not change the air flow characteristics depending on whether the end 24*a* is sealed when the heating fixture is mounted in the smoking system.

According to a preferred embodiment of the cleaning unit, the water is contacted with the interior of the heating fixture in a manner which causes turbulence during cleaning. Such turbulence can be increased by allowing the heating fixture to spin in the housing 4 during cleaning. Other techniques for causing turbulence include pulsating the water or using a sprayer to form high pressure water jets. Pulsation of water supplied to the cleaning unit can be accomplished by pulsating the water prior to entering the inlet 30 or by incorporating a pulsation member in the cleaning unit.

Figure 4A:
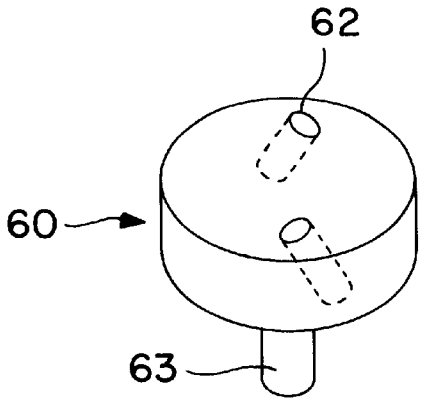
FIGS. 4 A–C show elements of a pulsation device which can be incorporated in the cleaning unit shown in FIG. 1.
Figure 4B:
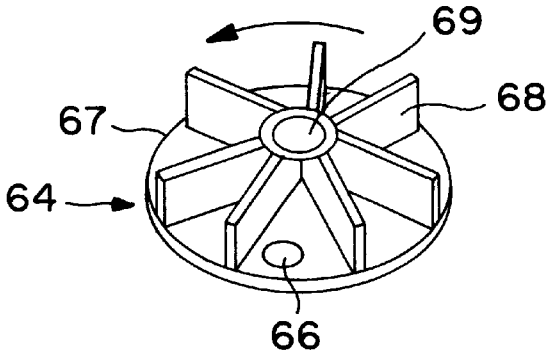
Figure 4C:
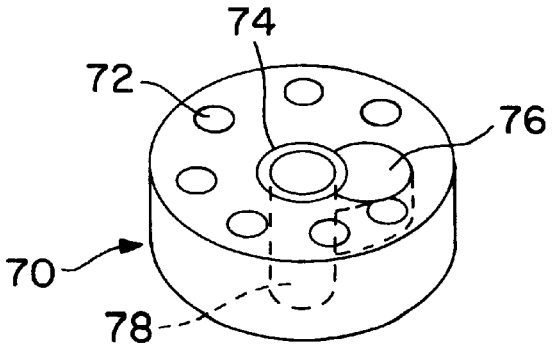

FIGS. 4A, 4B and 4C show parts of a pulsation device which can be incorporated in the cleaning unit. One technique for accomplishing pulsation of water within the interior of the heating fixture involves intermittent change of water pressure supplied to the manifold 40. For example, the upper section 6 can include one or more circumferentially spaced apart flow passages 52 and the cavity 38 can include a pulsation device comprised of an assembly of element 60 (shown in FIG. 4A), element 64 (shown in FIG. 4B) and element 70 (shown in FIG. 4C). In the assembly, elements 60 and 70 are connected by a spindle which passes through a central bore in element 64, thus allowing element 64 to rotate and create the pulsation of water in the cleaning unit As shown in FIGS. 4A–C, cylindrical element 60 has angled through holes 62 and a spindle 63 extending from the lower surface, spinner element 64 includes a through hole 66 in a circular bottom plate 67 and vanes 68 extending radially outward from a central tubular hub 69, and cylindrical element 70 includes a series of through holes 72 in an outer portion thereof, a central socket 74 and an elongated recess 76 in the upper surface and a central hole 78 in the lower surface connected to the recess 76. The pulsation member is assembled with the spindle 63 passing through the hub 69 and the end of the spindle 63 fixedly held in the socket 74 by mating threads or other expedient.

When the pulsation member is located in the cavity 38 of the cleaning unit 2, holes 72 are aligned with inlets 50 of bypass holes 52 and hole 78 is aligned with inlet 42 of manifold 40. In operation, pressurized water passing through holes 62 causes the spinner element 64 to spin whereby pressurized water passes through a respective hole 72 and an aligned bypass hole 52 as hole 66 comes into alignment with each hole 72. In addition, during each 360° rotation of the spinner element 64, the hole 66 aligns with the recess 76 and allows pressurized water to pass through hole 78 and then into the manifold 40. As a result, there is an intermittent change in pressure of water jetted from the outlets 46 in the manifold 40, the jets of water are pulsated against the interior of the heating fixture. Such pulsation loosens the condensate and aids in removal of the condensate from the heating fixture.

While one type of pulsation member has been described, it is contemplated that other types of pulsation creating arrangements can be used in the cleaning unit according to the invention. Additional modifications which can be incorporated in the cleaning unit are also possible. For instance, if it is desired to dilute the effluent exiting the outlet 39, the cleaning unit could include a filter arrangement through which the effluent passes prior to exiting the cleaning unit or the outlet could be arranged to direct the effluent directly into a drain. For example, the outlet 39 could be located directly over a drain or include a conduit which extends into a drain. Another possibility would be to collect the initial effluent, e.g., the first 3 to 4 ounces which may contain a higher concentration of the dissolved/removed condensate, and gradually bleed the initially removed effluent into the water which later passes through the cleaning unit. Another possibility is to make the manifold 40 movable such that the heating fixture is cleaned gradually, e.g., the manifold could move upwardly such that only the upper outlets 46 spray water into the bottom of the heating fixture at the beginning of cleaning and the water sprays from the outlets 46 progressively move upward during the cleaning operation.

Figure 5:
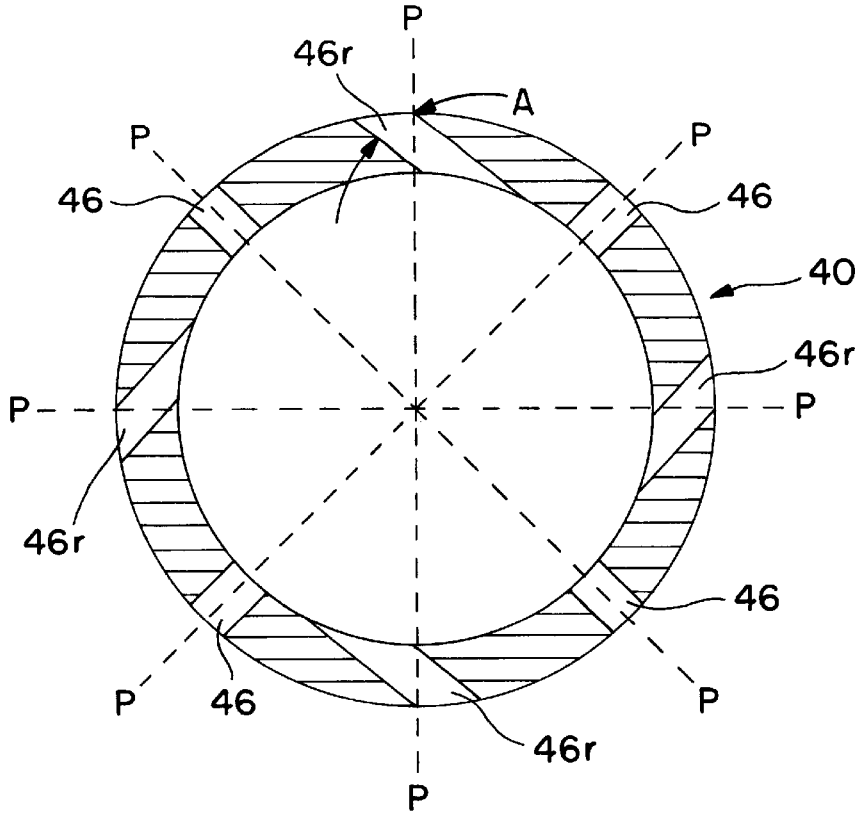
FIG. 5 is a cross-sectional end view of a manifold according to an embodiment of the present invention.

As seen in FIG. 1, the openings 46 in the manifold 40 direct the jets of pressurized water outwardly to clean the heating fixture 20. The manifold 40 is preferably tubular and includes a plurality of openings 46 disposed along a length of the manifold. As seen in the cross-section shown in FIG. 5, the openings 46 may extend radially from a longitudinal axis of the manifold or, as with the openings 46*r*, at some angle to the passage 44 or the passage 48, such as at an angle A relative to a radial projection P from a longitudinal axis of the manifold, which permits providing a different angle of attack on condensates on the can 28. If desired or necessary, a combination of radial openings 46 and non-radial openings 46*r* may be provided in the manifold.

Because cleaning of the heating elements 26 is not generally necessary as they tend to be self-cleaning by virtue of factors such as the high temperatures to which they are heated, it is presently understood to be desirable to direct the main cleaning energy on the can 28, not the heating elements. To this end, as seen in phantom in FIG. 1, the heating fixture 20 is preferably provided with a first keying member 121, such as a recess or a projection on the end wall 24*a* of the base 24 or, more preferably, a recess or a projection on a mouthpiece end 125 of the heating fixture, and a corresponding second keying member 123, such as a projection or a recess on the stop 12 on the interior sidewall 9 of the lower section 8 or, more preferably, a projection or a recess on the interior end wall 7 of the upper section 6, for mating with the first keying member. By providing appropriately configured first and second keying members 121 and 123, when the heating fixture 20 is received in the cavity 4 of the cleaning unit 2, the first and second keying members 121 and 123 mate and they radially fix the heating fixture relative to the cavity 4 in a position such that the jets of water exiting the openings 46 of the manifold are directed against the can 28 and avoid the heating elements 26. The keying arrangement ensures that, when the upper section 6 is secured to the lower section 8 around a heating unit, the openings 46 in the manifold direct water between the heating elements 26. If the first and second keying members 121 and 123 are provided proximate the base 24 of the heating fixture 20 and the interior sidewall 9 of the lower section 8, it is preferred that the upper section 6 and the lower section 8 be attachable relative to each other, such as by a further keying arrangement, such that the positioning of the manifold 40 and its openings 46 relative to the heating elements 26 is ensured. If the first and second keying members 121 and 123 are provided proximate the interior end wall 7 of the upper section 6 and the mouthpiece end 125 of the heating fixture 20, when the first and second keying members mate, proper alignment of the openings 46 of the manifold 40 relative to the heating elements 26 is automatically ensured without the need for further ensuring that a particular alignment exists between the upper section 6 and the lower section 8.

Figure 6:
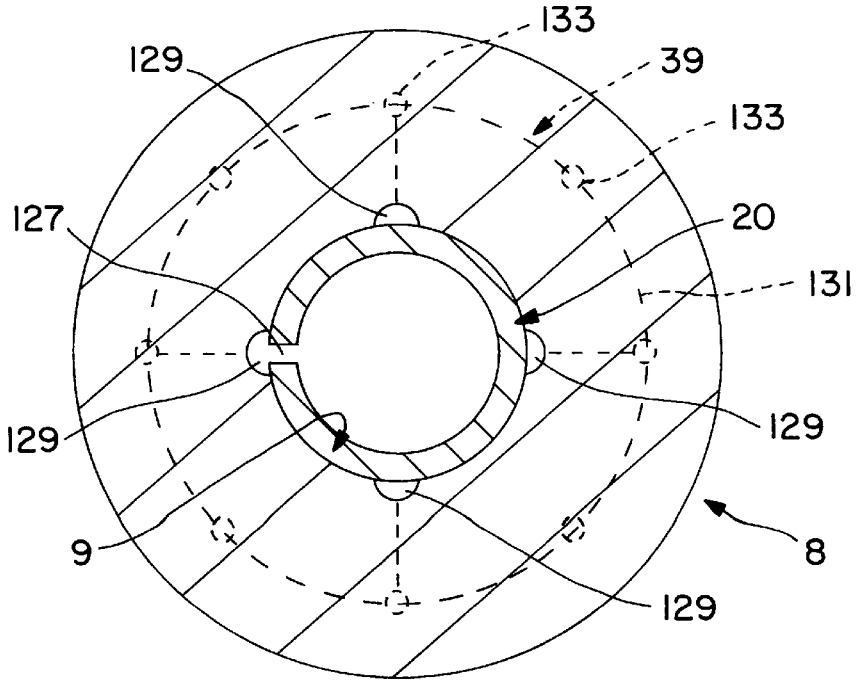
FIG. 6 is a cross-sectional top view of an outlet arrangement for a cleaning unit according to an embodiment of the present invention.

As seen in FIG. 6, the heating fixture 20 is typically provided with at least one radial opening 127 that, when the smoking system 100 (FIG. 2) is in operation, communicates with a puff-actuated sensor (not shown) separate from the heating fixture for sensing that a user is drawing on a cigarette 104. The sensor sends a signal to the logic circuit 110 which then controls the battery 108 such that power is provided to a heating element 26 to heat the cigarette. The interior side wall 9 of the lower section 8 of the cleaning unit 2 preferably includes a plurality of, preferably four, longitudinal openings 129 (also shown in phantom in FIG. 1) extending from below the O-ring 7 to the outlet 39. When the heating fixture 20 is disposed in the cavity 4 and the keying members 121 and 123 are mated, the radial opening 127 and one of the longitudinal openings 129 are aligned to permit communication between the inside of the can 28 and the openings 28 to facilitate drainage of the heating fixture. The longitudinal openings 129 may be arranged to communicate directly with a central outlet 39 as shown in FIG. 1. In an alternative embodiment, as shown in phantom in FIG. 6, the longitudinal openings 129 communicate with an outlet 39*a* in the form of a manifold 131 having a series of relatively smaller openings 133 arranged circumferentially around the bottom end of the lower section 8 to facilitate spraying of the waste water exiting the cleaning unit 2.

Figure 7:
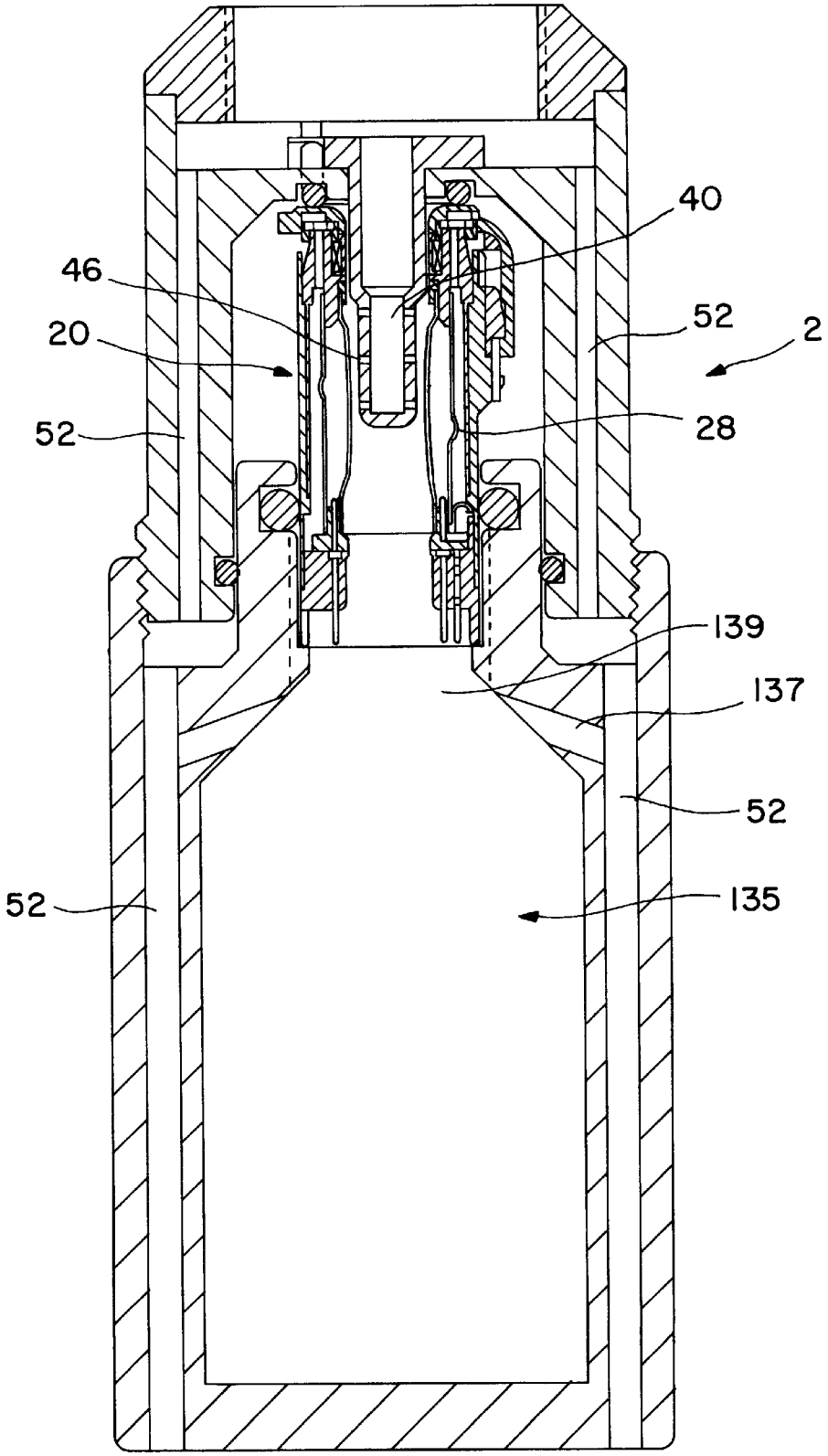
FIG. 7 is a side, cross-sectional view of a cleaning unit with a reservoir according to an embodiment of the present invention.

An arrangement that facilitates dilution of the waste water exiting the cleaning unit 2 is shown in FIG. 7. The cleaning unit 2 includes a bypass flow passage 52 which allows some of the pressurized water supplied to the inlet 30 to pass through the cleaning unit 2 without going through the manifold 40 and contacting the heating fixture 20. A reservoir 135 is disposed downstream of the heating element 20. The first several ounces of pressurized water that enters the manifold 40 and is directed against the heating unit 20, which first several ounces of water typically carries most of the condensate cleaned off of the can 28, enters the reservoir 135. The reservoir 135 is in fluid communication with the bypass flow passage 52 through at least one, preferably a plurality of, reservoir openings 137. In the embodiment shown in FIG. 7, the reservoir openings 137 are preferably disposed at or near a top end 139 of the reservoir 135. As additional water exits the openings 46 of the manifold 40 and passes through the heating unit 20 and into the reservoir 135, water in the reservoir mixes with the fresh water and the mixture is gradually displaced from the reservoir by being forced through the openings 137 and into the bypass passages 52. In this way, a small amount of the dirty water in the reservoir 135 can be mixed with and diluted by less dirty water entering the reservoir from the heater unit 20 and then further diluted with the clean water flowing through the bypass passages 52.

Figure 8:
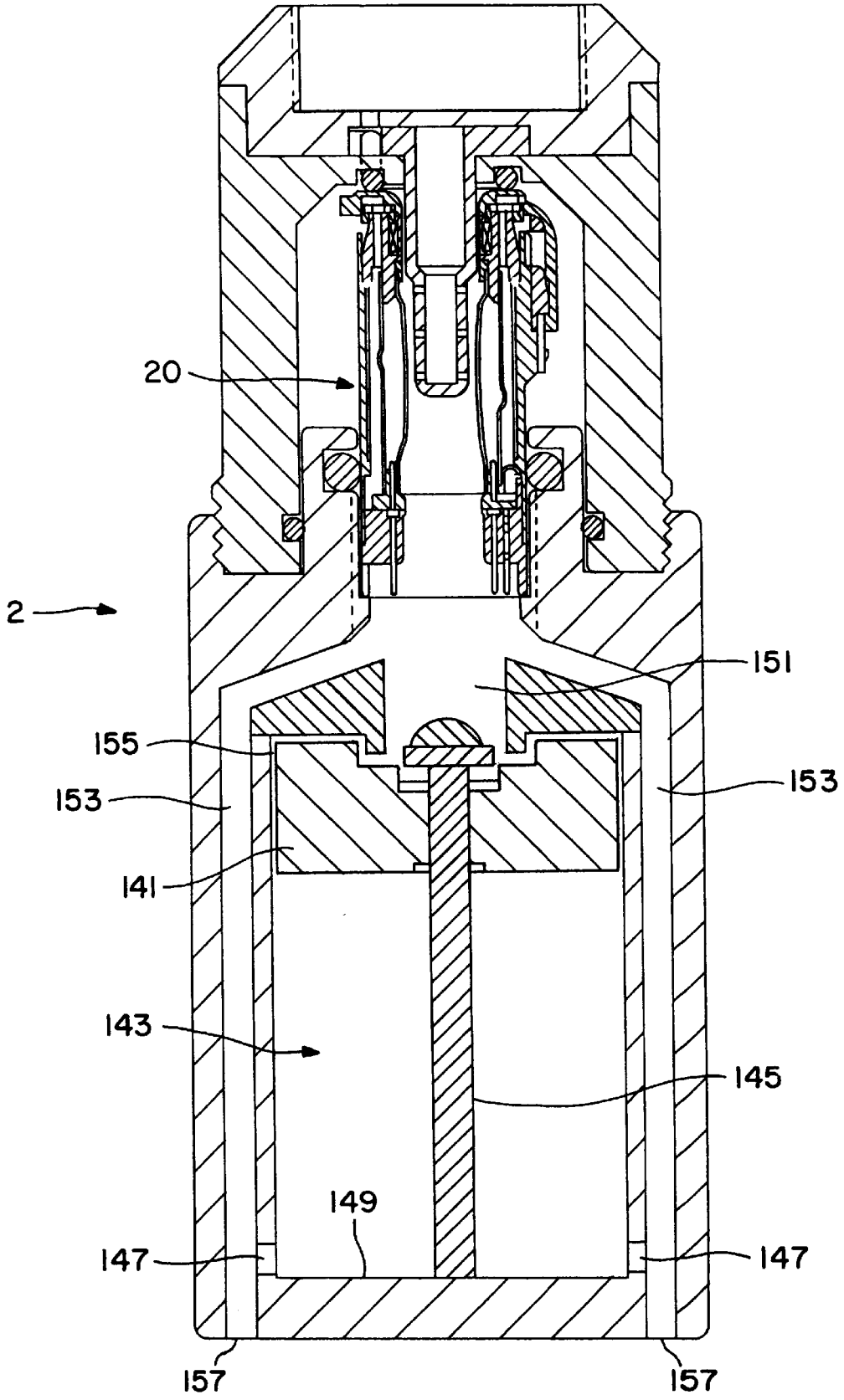
FIG. 8 is a side, cross-sectional view of a cleaning unit with a reservoir and float arrangement according to an embodiment of the present invention.

In another embodiment for facilitating dilution of waste water shown in FIG. 8, a float 141 is disposed in and movable along an axis of a reservoir 143, preferably along a guide pin 145. At least one, preferably a plurality of reservoir openings 147 are disposed at a bottom end 149 of the reservoir beneath a lowermost position of the float 141. The float 141 is preferably smaller than an interior dimension of the reservoir 143, or has one or more openings extending therethrough, and the reservoir includes an inlet opening 151 preferably situated directly in a path of flow of water exiting the heating fixture 20 such that the initial water flow from the heating fixture fills the reservoir.

The cleaning unit 2 can include bypass passages 52 as shown in FIG. 1 or, preferably, as shown in FIG. 8, includes passages 153 downstream of the heating fixture 20. The openings 147 extend from the interior of the reservoir 143 to the passages 153. The initial charge of dirty water exiting the heater unit 20 is, preferably by virtue of their physical configuration as seen in FIG. 8, preferentially directed through the inlet opening 151, not the passages 153, around and/or through the float 141, and into the reservoir 143, causing the float to rise to the top 155 of the reservoir.

When the reservoir 143 is full, and the float 141 has risen in the reservoir as a result of the initial charge, subsequent, less dirty or clean water exiting the heater unit 20 is substantially blocked from entry into the reservoir by the float, except to the extent that some mixing of subsequent water and dirty water may occur in the vicinity of the float where the subsequent water flows around and/or through the float. As a result of the blockage by the float 141, most of the subsequent water exiting the heater unit 20 impinges on a top side of the float, generating a force against the float to urge the float downwardly against a resisting force of the dirty water in the reservoir 141. After impinging upon the float 141, the subsequent water then flows to an outlet 157 through the passages 153. The dirty water in the reservoir 143 resists the force of the subsequent water impinging upon the float, but is gradually forced out of the openings 147 as a result of the force, and mixes with and is diluted by the subsequent water in the passages 153.

Figure 9:
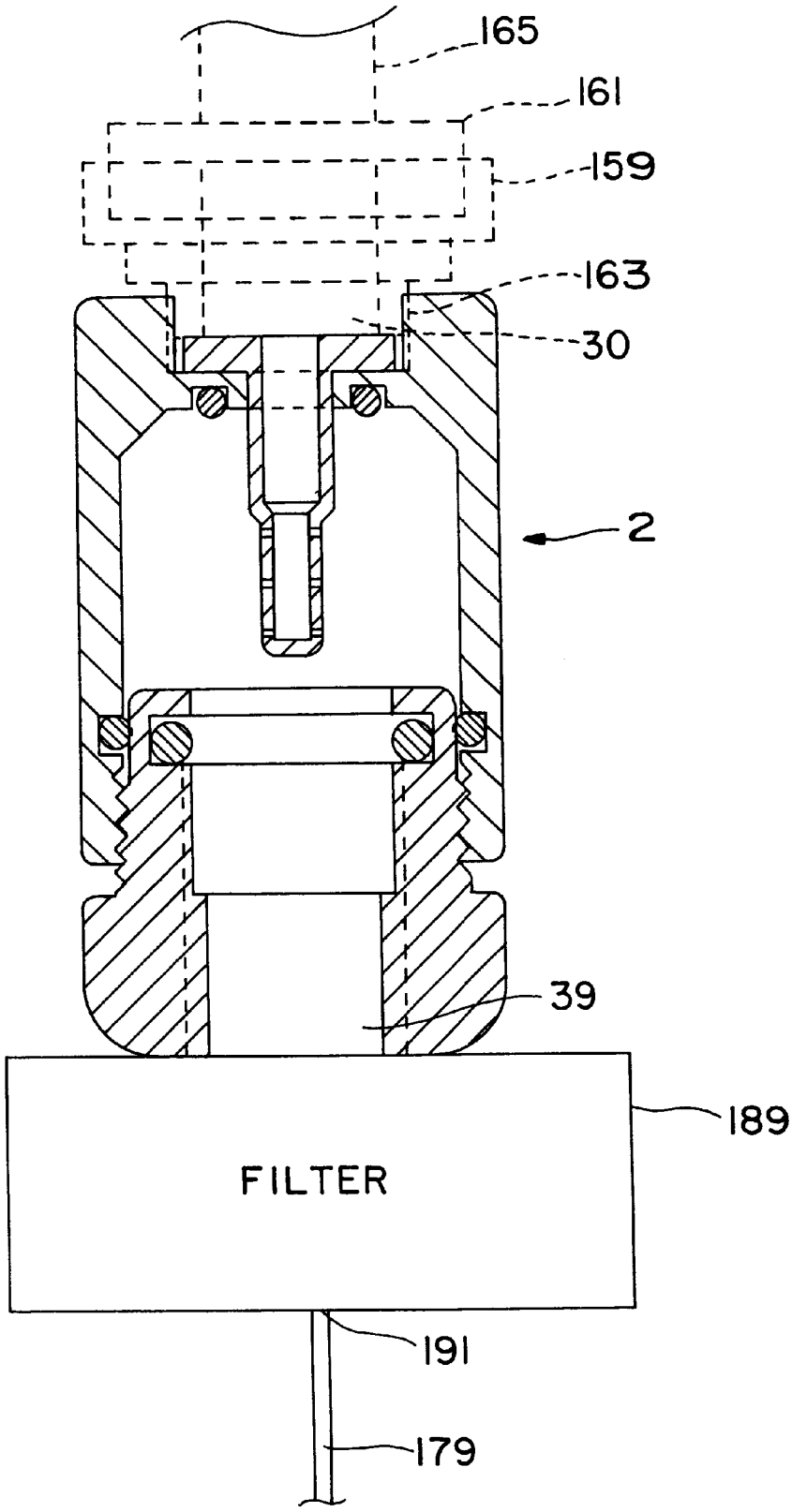
FIG. 9 is a side, cross-sectional schematic view of a cleaning unit, fittings for the cleaning unit, and a filter attached to the cleaning unit.

The cleaning unit 2 preferably has an inlet 30 for the pressurized water that is configured to be readily usable with a wide variety of sources for the pressurized water. In addition to the previously noted embodiments of the inlet 30, as seen in FIG. 9, the inlet may be attachable to fittings, such as a male or female quick connect-type fitting 159 that is attachable to a female or male quick connect-type fitting 161 on the source of pressurized water. The quick connect fitting 159 (or other fitting) may be removable for use of the cleaning unit 2 with sources of pressurized water not having a corresponding quick connect fitting. For example, the quick connect fitting 159 may be removably positioned relative to the rest of the cleaning unit 2 by a threaded connection 163 that may, itself, be attachable to a source of pressurized water, or by an O-ring arrangement having O-rings 34, 36, as described above.

Figure 10:
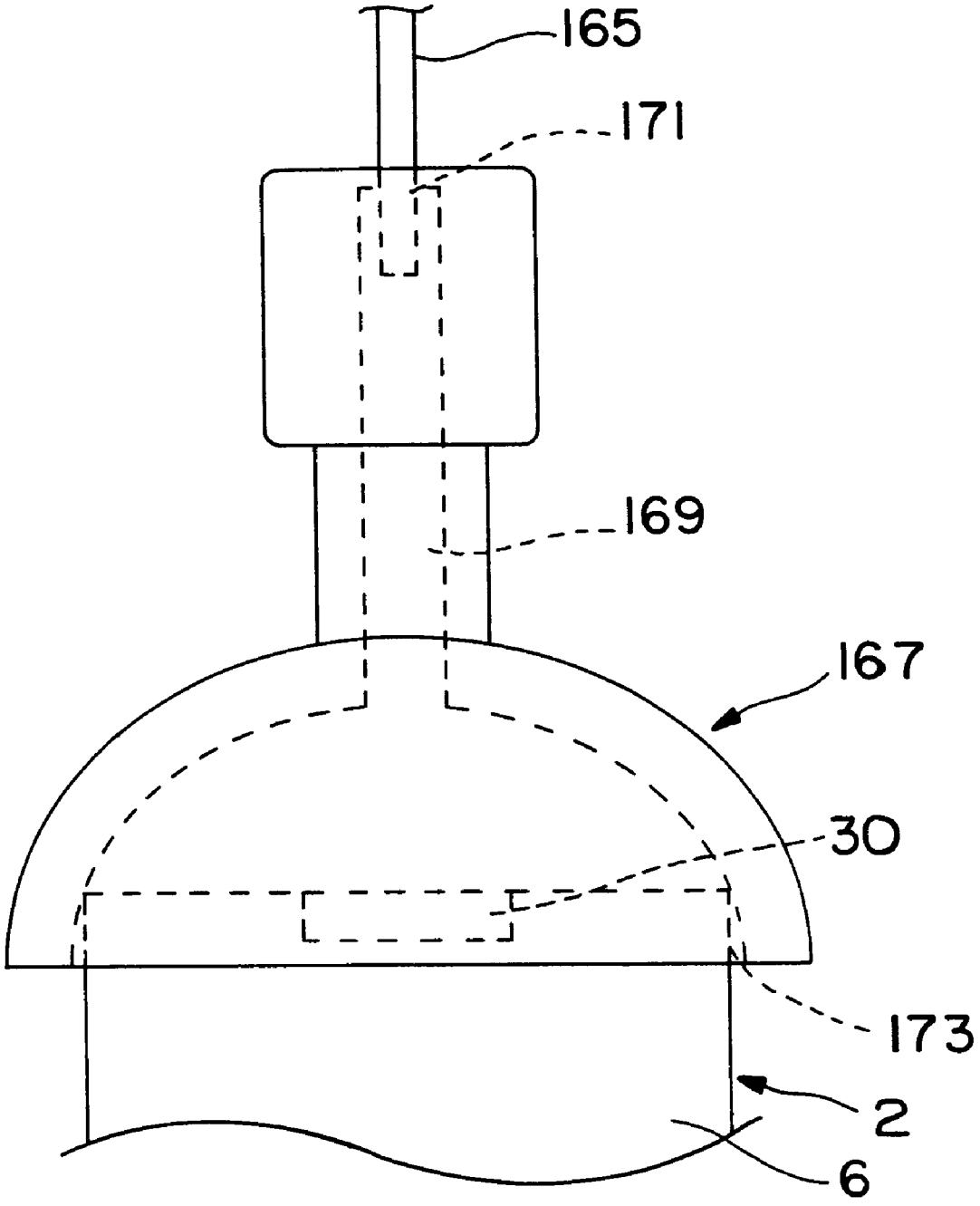
FIG. 10 is a schematic, side view of a fitting for a cleaning unit according to an embodiment of the present invention.

Moreover, the quick connect fitting 159 or other fitting may be replaceable with other types of fittings, such as threaded fittings and the like. Ordinarily, the source of pressurized water will include a tube 165, e.g., a rigid pipe, a flexible hose, or other suitable, tubular conduit, through which the pressurized water flows. As seen in FIG. 10, a preferred replacement fitting for the source of pressurized water includes a flexible fitting 167 adapted to be secured in position relative to a range of sizes of the tube 165 for the source of pressurized water. The fitting 167 preferably has a passage 169 extending therethrough. As shown in phantom in FIG. 10, the first end 171 of the passage is preferably adapted to be secured to a range of sizes of the tube 165, such as by being sufficiently flexible to fit over ends of tubes of different diameter and be secured thereto by friction, manually, or both, or with further clamping devices (not shown). The fitting 167 at the second end 173 of the passage 169 is preferably configured to permit holding of the rest of the cleaning unit 2 relative to the fitting such that the inlet 30 is in fluid communication with the source of pressurized water through the fitting passage. The fitting 167 is preferably sufficiently flexible such that the upper section 6 of the cleaning unit 2 is receivable in the passage 169 at the second end 173 and is secured thereto by friction with the fitting 167 or manually, or both, or with further clamping devices (not shown). In this way, the fitting 167 facilitates temporary operation of the cleaning unit 2 with a wide variety of sources of pressurized water.

As seen in FIG. 1, where the inlet 30 is manually held relative to the passage 169 at the second end 173 of the fitting, the cleaning unit 2 preferably includes a bypass flow passage 52 which allows some of the pressurized water supplied to the inlet to pass through the cleaning unit without contacting the heater unit 20. A bypass flow valve 175 that is movable between an open position and a closed position may be provided to open and close the bypass flow passage 52 together with means 177, such as a spring loaded lever, spring loaded button, or the like, that contacts the fitting 167 and moves the bypass flow valve to the open position when the cleaning unit 2 is held in position relative to the fitting and for moving the bypass flow valve to the closed position when the housing is not held in position relative to the fitting.

Figure 11:
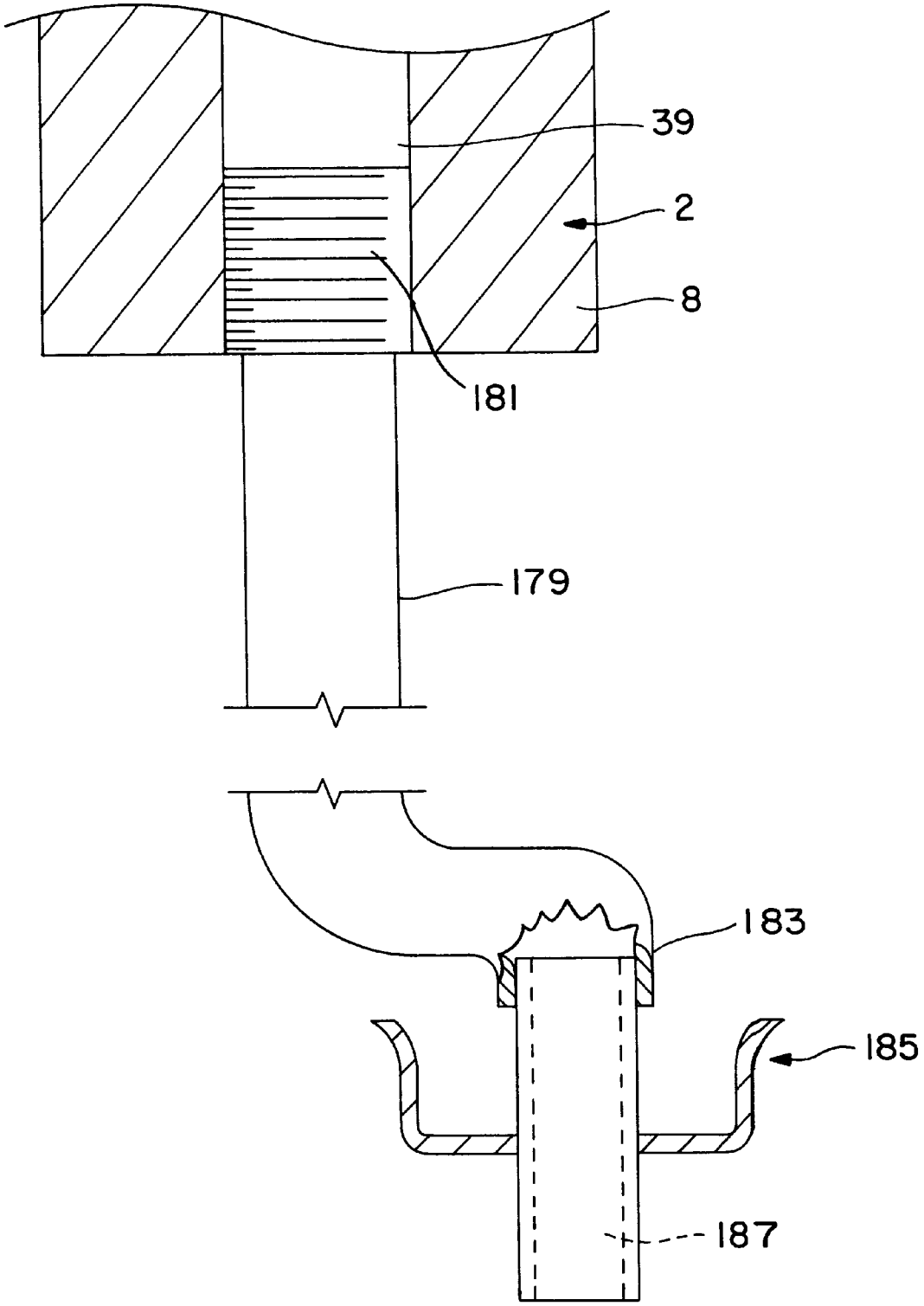
FIG. 11 is a side, cross-sectional schematic view of a cleaning unit together with a drain arrangement according to an embodiment of the present invention.
Figure 12:
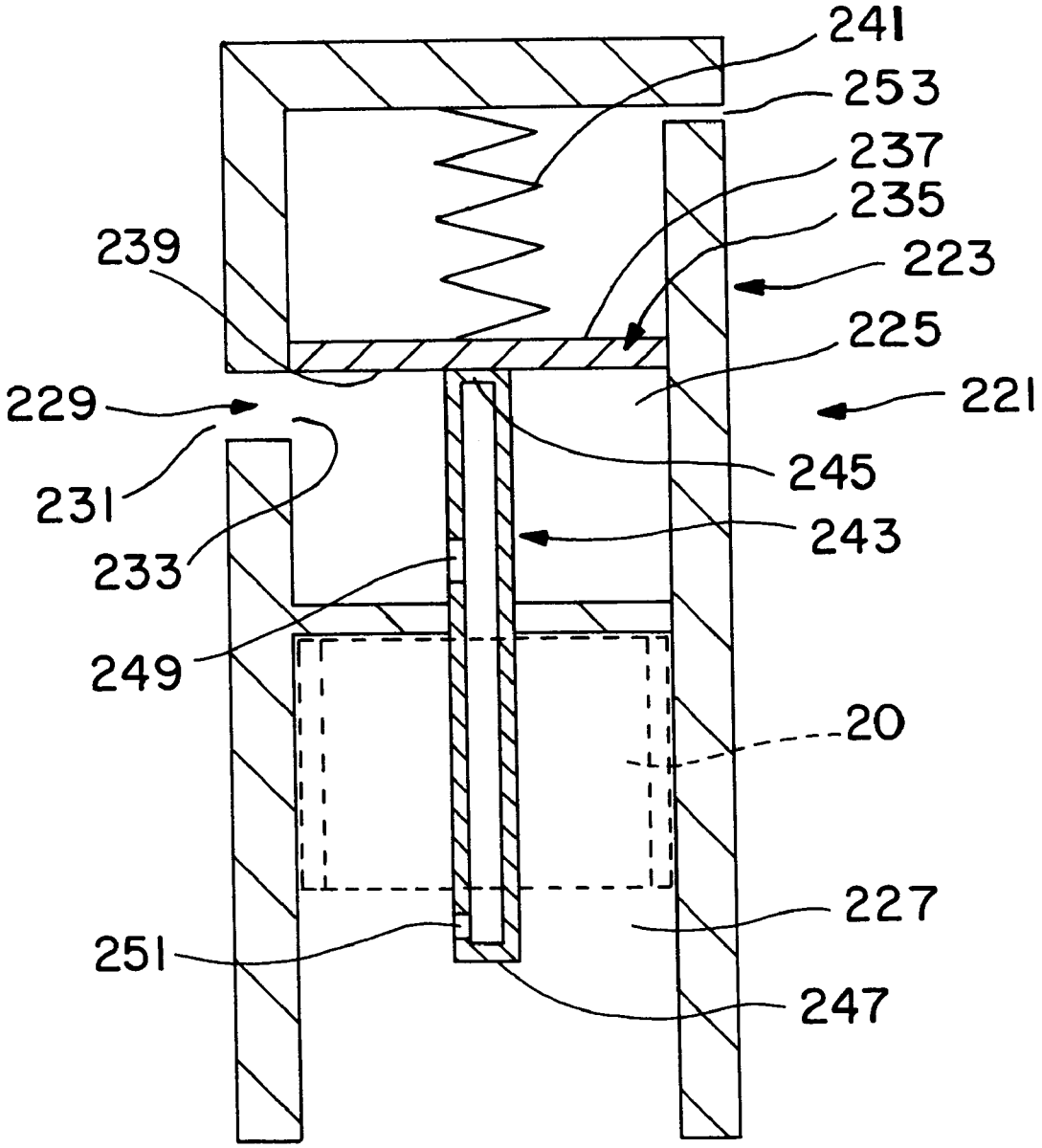
FIG. 12 is a side, cross-sectional schematic view of a cleaning unit according to a further embodiment of the present invention.

In addition to, or instead of the waste water dilution techniques discussed above, as seen in FIG. 11, the outlet 39 of the cleaning unit 2 may be connected to a tube 179 having a first end 181 attached to the outlet and a second end 183. A user may place the second end 183 directly down a drain (not shown) to minimize any possibility of inadvertent contact with waste water from the cleaning unit 2. More preferably, to minimize the possibility of the tube 179 being damaged by, for example, a garbage disposal in the drain, the second end of the tube 183 is preferably attached to a member 185 such as a plug or a drain catch that is adapted to be fitted in the sink drain to a limited extent. The member 185 preferably has a passage 187 extending therethrough and the tube 183 and the member are attached such that the tube is in fluid communication with the passage 187.

As seen in FIG. 9, the outlet 39 may, instead of being extended by a tube 179 directly to a drain, be attached to a filter 189. If desired or necessary, an outlet 191 of the filter 189 may then be extended to a drain by a tube or a tube and member arrangement. A variety of suitable filters 189 are known. Suitable filters 189 are known to include, but are not intended to be limited to, 14 mesh activated charcoal filters having density of approximately 0.6 gm/cc$^{3,}$ 20–60 mesh, non-ionic polystyrene resins having density of approximately 0.7 gm/cc$^3$, or 50–100 mesh cation exchange polystyrene resin, acid treated filters, having density of approximately 0.7 gm/cc$^3$. FIG. 9 shows an embodiment of the cleaning device without bypass passages 52, however, such passages can be provided if desired or necessary. It will be understood that bypass passages 52 can be provided or omitted in the various embodiments described herein, except to the extent otherwise noted.

In addition to, or instead of, the techniques for protection against concentrated dirty waste water including dilution of waste water, filtering, and directing the waste water to a drain described above, the cleaning unit can be constructed in such a manner that the heating unit is more gradually cleaned than in previously described embodiments. Another embodiment of the cleaning unit 221 is shown in FIG. 13. The cleaning unit 221 includes a housing 223 that includes a first cavity 225, and a separate second cavity 227 for receiving a heating unit 20 in a manner similar to the manner in which the heating unit 20 is received in the above-described embodiments. The housing 223 further includes a passage 229 including an inlet end 231 connectable to a source of pressurized water and an outlet end 233 through which pressurized water from the source of pressurized water is introduced to the first cavity 225. The inlet end 231 is preferably an inlet of the type used in above-described embodiments.

A piston 235 having a top side 237 and a bottom side 239 is movably disposed in the first cavity 225. The outlet end 233 of the passage 229 is disposed below the bottom side 239 of the piston 235. A resistance element 241, such as a spring, an elastic rubber element, or the like, is disposed in the first cavity 225 against the top side 237 of the piston 235.

A tube 243 is attached at a first end 245 to the bottom side 239 of the piston 235 and is preferably closed at a second end 247. The tube 243 has at least one, preferably a plurality, of first openings 249 provided in the tube such that each first opening is disposed in first cavity 225. The tube 243 also has at least one, preferably a plurality, of second openings 251 provided in the tube such that each second opening is disposed in the second cavity 227.

When pressurized water enters the first cavity 225, it generates a force that acts against the bottom side 239 of the piston 235 to cause the piston and the tube to move upwardly against a force of the resistance element 241 acting against the top side 237 of the piston. At the same time, the water in the first cavity 225 enters the first opening 249 of the tube 243 and exits the second opening 251 of the tube in an outwardly directed stream. As the tube 243 and piston 235 rise against the force of the resistance element, the outwardly directed stream of water from the second opening 251 moves upwardly along a length of the heater unit 20 to clean the heater unit. Prior to commencement of the cleaning operation, the uppermost second opening 251 is preferably disposed below a lowermost part of the heater unit 20 and, as the second opening and the stream of water emanating therefrom rise, the heater unit is gradually cleaned.

The rate at which the heater unit 20 is cleaned can be varied as desired by adjusting parameters such as a resistance of the resistance element 241, a size of the passage 229 and its inlet and outlet ends 231 and 233, an area of the piston exposed to water in the first cavity, and a size and number of first and second openings 249 and 251 in the tube. It will be appreciated from the foregoing description that the tube 243 is sufficiently long, and the first and second openings 249 and 251 are provided along the length of the tube in positions such that, at uppermost positions of the piston 235 and the tube 243, the second opening does not enter the first cavity 225 and, at lowermost positions of the piston and the tube, the first opening does not enter the second cavity 227.

The first cavity 225 is preferably provided with a bleed hole 253 to permit flow of whatever fluid is present in the first cavity from and into the first cavity above the piston 235 during compression and expansion of the resistance element 241. The piston 235 preferably completely seals an upper space defined by the first cavity 225 and the top side 237 of the piston from a lower space defined by the first cavity and the bottom side 239 of the piston. O-rings (not shown) are preferably provided in grooves (not shown) on an outer circumference of the piston to seal the upper space from the lower space.

A preferred resistance element 241 is a spring. The spring may be of a type that has a different spring force at different temperatures, such as a spring including a bimetallic portion. Thus, when the cleaning unit 20 warms up as a result of warm water entering from the source of pressurized water, the resistance provided by the resistance element 241 decreases, resulting in an increase in the rate at which the resistance element is compressed.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A cleaning unit for removing condensates from a component of a smoking device comprising:

a housing having a cavity therein adapted to receive a component of a smoking device, the housing including an inlet adapted for connection to a source of pressurized water and a flow passage adapted to direct pressurized water to a portion of the component to be cleaned, wherein the housing includes at least one sealing member in the cavity, the sealing member engaging an exterior of the component and sealing off a portion of the cavity from the pressurized water.

2. The cleaning unit of claim 1, wherein the component comprises a heating fixture of a smoking device wherein a cigarette is heated by one or more heating elements and smoke condensate builds up in an interior of the heating fixture.

3. The cleaning unit of claim 2, wherein the housing includes a main body and a removable section, the removable section including a surface which engages the heating fixture when the heating fixture is in the cavity and the removable section is attached to the main body.

4. The cleaning unit of claim 3, wherein the housing includes a spray member which directs one or more jets of pressurized water against the interior of the heating fixture when pressurized water is supplied to the inlet.

5. The cleaning unit of claim 1, wherein the housing includes a bypass flow passage which allows some of the pressurized water supplied to the inlet to pass through the housing without contacting the component.

6. The cleaning unit of claim 1, wherein the housing includes a pulsation member which causes changes in pressure of the pressurized water passing through the flow passage.

7. The cleaning unit of claim 1, wherein the housing includes a tubular member which directs jets of pressurized water radially outward against an inner surface of the component.

8. The cleaning unit of claim 1, wherein the component of the smoking device is a heating fixture including a tubular member, the housing including a spray member disposed inside of the tubular member when the component of the smoking device is received in the cavity, the spray member including one or more openings for directing one or more jets of pressurized water outwardly toward an interior surface of the tubular member.

9. The cleaning unit of claim 8, wherein the spray member is tubular and includes a plurality of openings disposed along a length of the spray member.

10. The cleaning unit of claim 8, wherein the spray member is tubular and the one or more openings extend radially from a longitudinal axis of the spray member.

11. The cleaning unit of claim 8, wherein the spray member is tubular and the one or more openings extend at an angle to a radial projection from a longitudinal axis of the spray member.

12. The cleaning unit of claim 8, wherein the heating fixture includes one or more heater elements disposed inside of the tubular member and fixed in position relative thereto, and a first keying member, the housing including a second keying member for mating with the first keying member such that, when the heating fixture is received in the cavity of the housing, the first and second keying members radially fix the heating fixture relative to the housing in a position such that the one or more jets of water are directed against the tubular member and avoid the one or more heater elements.

13. The cleaning unit of claim 12, wherein the heating fixture includes at least one radial opening, and the housing includes at least one longitudinal opening extending from the cavity to an exterior of the housing, the at least one radial opening and the at least one longitudinal opening being aligned when the first and second keying members are in a mated condition.

14. The cleaning unit of claim 1, wherein the housing includes a bypass flow passage which allows some of the pressurized water supplied to the inlet to pass through the housing without contacting the component, and a reservoir disposed downstream of the component and in which pressurized water that has been directed against the portion of the component to be cleaned is received, the reservoir being in fluid communication with the bypass flow passage through at least one reservoir opening.

15. The cleaning unit of claim 14, wherein the at least one reservoir opening is disposed at a top end of the reservoir.

16. The cleaning unit of claim 14, wherein the housing further includes a float disposed in and movable along an axis of the reservoir, the at least one reservoir opening being disposed at a bottom end of the reservoir beneath a lowermost position of the float.

17. The cleaning unit of claim 1, further comprising a cavity disposed between the inlet for the source of pressurized water and the flow passage for receiving a cleaning tablet.

18. The cleaning unit of claim 1, wherein the inlet for the source of pressurized water includes a quick connect fitting.

19. The cleaning unit of claim 1, wherein the source of pressurized water includes a tube through which the pressurized water flows, and wherein the inlet for the source of pressurized water includes a flexible fitting adapted to be secured in position relative to a range of tube sizes.

20. The cleaning unit of claim 1, further comprising a fitting, the fitting having a passage extending therethrough and being adapted to be secured to the source of pressurized water and to permit holding of the housing relative to fitting such that the inlet of the housing is in fluid communication with the source of pressurized water through the fitting passage.

21. The cleaning unit of claim 20, wherein the housing includes a bypass flow passage which allows some of the pressurized water supplied to the inlet to pass through the housing without contacting the component, and a bypass flow valve that is movable between an open position and a closed position to open and close the bypass flow passage, and means for moving the bypass flow valve to the open position when the housing is held in position relative to the fitting and for moving the bypass flow valve to the closed position when the housing is not held in position relative to the fitting.

22. The cleaning unit of claim 1, wherein the housing includes an outlet for water downstream of the flow passage and the component.

23. The cleaning unit of claim 22, further comprising a tube having a first end attached to the outlet.

24. The cleaning unit of claim 23, further comprising a member adapted to be fitted in a sink drain, the member having a passage extending therethrough, and wherein the tube has a second end attached to the member such that the tube is in fluid communication with the passage.

25. The cleaning unit of claim 22, further comprising a filter attached to the outlet.

26. The cleaning unit of claim 22, wherein the housing includes an interior wall against which an exterior wall of the component abuts, and the outlet includes a plurality of spaced openings in fluid communication with the cavity through at least one groove in the interior wall of the housing.

27. A cleaning unit for removing condensates from a component of a smoking device comprising:

a housing having a cavity therein adapted to receive a component of a smoking device, the housing including an inlet adapted for connection to a source of pressurized water and a flow passage adapted to direct pressurized water to a portion of the component to be cleaned, wherein the component comprises a tubular heating fixture of a smoking device wherein a cigarette is fitted in an interior of the heating fixture, the cigarette is heated by one or more heating elements and smoke condensate builds up in the interior of the heating fixture, the housing including a spray member which extends into the interior of the heating fixture and sprays the pressurized water against the condensate build up.

28. The cleaning unit of claim 27, wherein the housing includes a main body and a removable section, the removable section including a surface which presses the heating fixture against the main body when the heating fixture is in the cavity and the removable section is attached to the main body.

29. The cleaning unit of claim 27, wherein the spray member includes a plurality of outlets which direct jets of pressurized water against the interior of the heating fixture when pressurized water is supplied to the inlet.

30. The cleaning unit of claim 27, wherein the housing includes a bypass flow passage which allows some of the pressurized water supplied to the inlet to pass through the housing without contacting the heating fixture.

31. The cleaning unit of claim 30, further comprising a pulsation member which causes changes in pressure of the pressurized water passing through the spray member, the pulsation member comprising a rotatable element having at least one hole adapted to intermittently block supply of at least some of the pressurized water to the bypass passage or spray member during rotation of the pulsation member.

32. The cleaning unit of claim 27, wherein the housing includes a pulsation member which causes changes in pressure of the pressurized water passing through the spray member.

33. The cleaning unit of claim 27, wherein the housing includes at least one sealing member in the cavity, the sealing member engaging an exterior of the heating fixture and sealing off a portion of the cavity from the pressurized water.

34. The cleaning unit of claim 27, wherein the heating fixture includes at least one port providing a fluid passage for controlled flow of air from the exterior to the interior of the heating fixture, the housing including a first sealing member in the cavity engaging a first portion of the heating fixture and a second sealing member engaging a second portion of the heating fixture, the first and second sealing members forming a pressurized space in fluid communication with the port.

35. The cleaning unit of claim 27, wherein the heating fixture includes longitudinally extending and circumferentially spaced apart heating elements, the spray member including outlets oriented with respect to the heating fixture so as to direct jets of pressurized water between the heating elements.

36. The cleaning unit of claim 35, wherein the heating fixture includes a cylindrical can enclosing the heating elements, the can having an inner surface on which the condensates accumulate during use of the heating fixture in the smoking device, the spray member being oriented such that the jets of pressurized water impinge against the inner surface of the can.

37. The cleaning unit of claim 27, wherein the heating fixture includes a base at one end thereof, a tubular housing extending from the base and a cylindrical can spaced inwardly of the tubular housing, the base including at least one drainage hole extending from a space between the tubular housing and the can.

38. The cleaning unit of claim 37, wherein the base includes an inner surface which defines an opening having a central axis which passes through an end wall of the base, the drainage hole extending through the inner surface at an acute angle to the central axis.

39. A cleaning unit for removing condensates from a component of a smoking device, comprising:

a housing, the housing including a first cavity, a second cavity for receiving a component of a smoking device, and a passage including an inlet end connectable to a source of pressurized water and an outlet end through which pressurized water from the source of pressurized water is introduced to the first cavity;

a piston having a top side and a bottom side and being movably disposed in the first cavity, the outlet end of the passage being disposed below the bottom side of the piston;

a resistance element disposed in the first cavity against the top side of the piston;

a tube attached at a first end to the bottom side of the piston and being closed at a second end, the tube having at least one first opening provided in the tube such that the at least one first opening is disposed in first cavity and at least one second opening provided in the tube such that the at least one second opening is disposed in the second cavity, wherein, when pressurized water enters the first cavity, it generates a force that acts against the bottom side of the piston to cause the piston and the tube to move upwardly against a force of the resistance element acting against the top side of the piston, and it enters the at least one first opening of the tube and exits the at least one second opening of the tube in an outwardly directed stream.

40. The cleaning unit of claim 39, wherein the resistance element is a spring.

41. The cleaning unit of claim 40, wherein a force of the spring is temperature dependent.

42. The cleaning unit of claim 40, wherein the spring is at least partially made of a bimetallic material.

* * * * *